United States Patent [19]

Zapf et al.

[11] 4,032,335

[45] June 28, 1977

[54] PROCESS FOR MAKING METALLIC, MOLDED COMPOSITE BODIES

[75] Inventors: Gerhard Zapf, Radevormwald; Lothar Albano-Müller, Schwelm; Horst Kiethe, Remscheid; Rainer Röhlig, Radevormwald, all of Germany

[73] Assignee: Sintermetallwerk Krebsoege GmbH, Krebsoge, Germany

[22] Filed: Nov. 21, 1975

[21] Appl. No.: 634,009

[30] Foreign Application Priority Data

Dec. 19, 1974 Germany ..... 2460013

[52] U.S. Cl. ..... 75/208 R; 75/200; 75/211; 75/214; 102/67

[51] Int. Cl.[2] ..... B22F 3/16; F42B 13/48

[58] Field of Search ..... 75/208 R, 214, 211, 75/200; 102/67

[56] References Cited

UNITED STATES PATENTS

| | | | |
|---|---|---|---|
| 3,538,550 | 11/1970 | Durrwachter et al. | 75/208 R |
| 3,815,504 | 6/1974 | Tieben | 102/67 |

FOREIGN PATENTS OR APPLICATIONS

| | | | |
|---|---|---|---|
| 1,943,472 | 3/1971 | Germany | 102/67 |

OTHER PUBLICATIONS

Hirschhorn, J. S., *Introduction to Powder Metallurgy*, American Powd. Met. Ins., N. Y., 1969, pp. 107–109.

Jones, W. D., *Fundamental Principles of Powder Metallurgy*, Edward Arnold, London, 1960, pp. 260–270.

*Primary Examiner*—Richard E. Schafer

*Attorney, Agent, or Firm*—Lawrence I. Field

[57] ABSTRACT

A process for producing composite bodies consisting of discrete particles, embedded in a metallic embedding material, in which the particles are positioned relative to the embedding material and the resulting composite is subjected to isostatic compression at pressures which suffice to cause the particles to be embedded.

8 Claims, 2 Drawing Figures

PROCESS FOR MAKING METALLIC, MOLDED COMPOSITE BODIES

Figure 1:
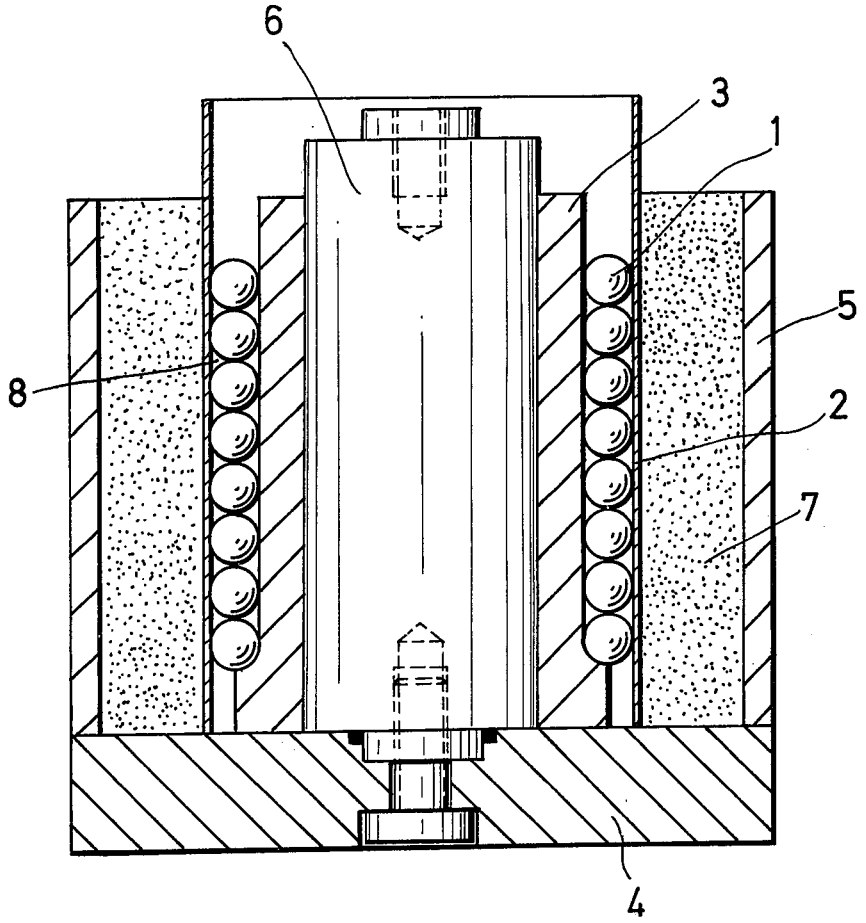

This invention relates to a process for making metallic, molded bodies which include discrete particles incorporated in a metal embedding material.

Molded bodies of the above mentioned kind may be made, for instance, by casting. Thus, it is known to make metal-ceramic compound bodies by pouring molten aluminum around pieces of corundum in a casting mold. This process, however, is very costly because the compound body requires fusion of the metal. Furthermore, there are difficulties in keeping the pieces of corundum at the proper place in the mold or in the molten metal.

One is faced with another drawback in the known process if a solid bond and/or reaction between the metallic embedding material and the incorporated particles must be avoided when making the compound body. To that extent the known process is restricted to using embedded particles which are inert or sufficiently resistant with respect to bonding to the molten metal. For instance, metal particles of low melting point may not be used in the known process, because they will be attacked or at least partly dissolved by the molten metal.

In order to avoid the difficulties associated with the use of molten metals, it is known how to make compound bodies by so-called blast cladding (Sprengplattieren). Hard metal spheres for instance are pressed into a ductile metal substrate at moderate temperatures in the manner of explosive shaping. However, the high forces required to deform the substrate metal restricts application of this process to embedding relatively small spheres, and further the blast cladding procedure may not be carried out for particles of other shapes, for instance irregular ones with edges. In addition, blast cladding may be carried out only with combinations of materials which differ relatively sharply in hardness. This, however, entails the risk there may occur cold welding and hence a metal bond between the spheres and the substrate metal. This will be a drawback if the bond between spheres and embedding material is meant to be only transient or when the spheres are supposed to detach from the embedding mass under certain conditions.

The invention therefore addresses the problem of avoiding the disadvantages in the prior art and more particularly to create a process by means of which discrete particles such as spheres or spherical particles may be incorporated into a metal embedding material without a solid bond forming and/or without a reaction between the embedding material and the particles.

This problem is solved by first positioning the particles relative to a metal substrate and then providing a metal sheath around the particles after which the total body comprising substrate, particles and sheath are compressed isostatically.

The substrate and/or the sheath may consist of a cast material, for instance of low carbon steel. Plates or sheets placed around the particles during isostatic compression are also suitable. If the substrate and the sheath are of cast material, isostatic compression produces a kind of ball cage. The clear space between the substrate and a cast sheath also may be filled with a powder.

Preferably, the sheath consists of a metal powder enclosing the particles following fixation to the substrate in which case, the compressed body must be subsequently sintered.

A powder mixture of 4% of a manganese-molybdenum-chromium alloy containing for instance 23–25% chromium, 23–25% manganese, 23–25% molybdenum and 0.4–0.6% carbon, the remainder being iron except for incidental impurities, is particularly well suited for the sheath or embedding material. Other suitable powders include:

1. a powder of 4% of chromium carbide ($Cr_3C_2$) and 3% nickel, the remainder being iron except for incidental impurities;
2. 1–6% manganese as ferromanganese containing 80% manganese, the remainder being iron with a particle size less than 63 microns;
3. 0.1–0.4% carbon, the remainder being iron except for incidental impurities; and
4. 4% manganese, 1.5% copper and 0.2% carbon, the remainder being iron.

The process of the invention is applicable to a large number of metal-metal or metal-ceramic combinations provided the discrete particles do not melt during sintering.

The sintering temperature being appreciably lower than the melting point of the embedding material, a far greater number of materials are applicable as regards the particles than when embedding into a molten embedding material. On the other hand, in contrast with blast cladding, softer materials may be used for the particles and harder materials for the substrate and/or the sheath. The particles furthermore may be irregular in shape because the powder is capable of fully enveloping and furthermore may be precondensed. Preferably however, the particles are of greater hardness and/or higher density than the substrate and/or the sheath.

A further advantage of the process of the invention consists in selecting sintering temperatures and durations within wide limits so as to adjust the bonding of the discrete particles to the substrate and in the metal embedding material. For instance, hard metal balls may be incorporated into an embedding substance essentially consisting of iron to which they will be relatively loosely bonded. The embedding material, in contrast with the balst cladding process, may be of relatively high hardness and might even be quite brittle. On the other hand, particle bonding also may be controlled by providing the particles with a covering layer, for instance of copper or inert oxide, which will form a bond during sintering.

Fixation of the discrete particles may take place in recesses of the substrate, for instance in grooves or in cups, with or without the use of a binder. Furthermore, the particles used in conformity with the process of the invention also may be held firmly between an externally smooth substrate and a holding sleeve, the latter being removed prior to isostatic compression. This may be carried out while the powder is still being introduced or immediately prior to compression. The holding sleeve is easily removed from the compression tool if the compression tool is made to vibrate. This simultaneously provides the advantage of powder consolidation.

Another possibility consists in positioning particles of a magnetic material relative to the substrate or holding the particles of a magnetic material by means of a magnetically permeable cover layer used with a magnetic field. In this way one obtains the advantage, as is the case when using the holding sleeve, that no permanent bonding is effected between the particles and the substrate, in order to carry out the isostatic compression.

The substrate may be embossed or it may be cast. However, powder metallurgically produced substrates are particularly suitable, particularly those which have been provided with recesses during compression of the powder. If the substrate is of sufficient strength, it may not be necessary to sinter it following compression, or it may only require sintering at a relatively low temperature of 700°–900° C for instance. This is advantageous because then the particles will easily force themselves into the soft substrate during isostatic compression. On the other hand, a substrate might be hardened to achieve maximum accuracy of particle position during the ensuing isostatic compression. A relatively hard substrate also will be obtained with some powders if the sintering temperature falls within 1000°–1300° C, for instance 1,280° C.

Figure 2:
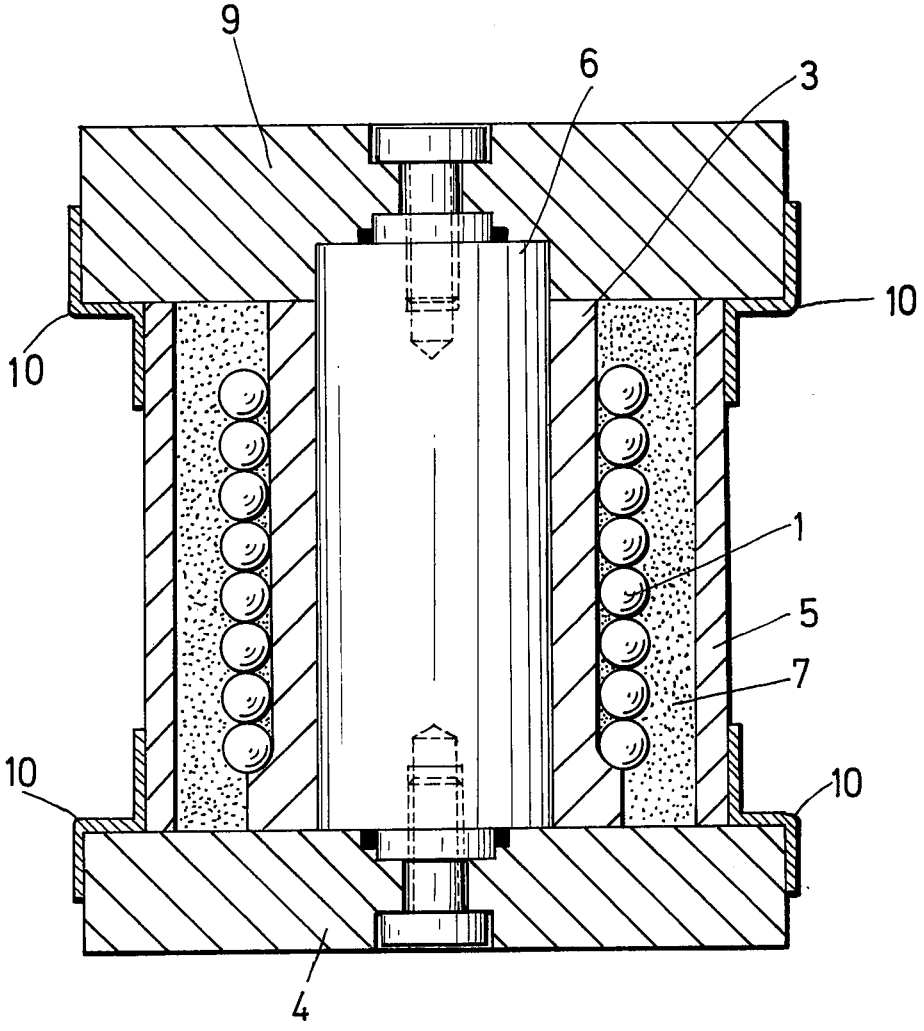

This invention will be better understood from the examples which follow together with the drawings in which:

FIG. 1 is a view, partly in section, showing a pressing tool following filling of a powder sheath, and FIG. 2 is a similar view showing the pressing tool shown in FIG. 1 during processing.

The process of this invention may be carried out so that the discrete particles 1, e.g. hard metal balls 1, are fixedly positioned in a desired manner by means of a holding sleeve 2 concentric and with the outer wall of a cylindrical substrate 3 which may have been produced by a powder metallurgy process or by casting. The process of the invention is performed in a pressing tool which includes a lower cover 4, an elastic compression casing 5 and a core 6. The hard metal balls are located in axially parallel recesses provided in cylindrical substrate 3. After filling with powder 7, positioning sleeve 2 is slowly pulled out of the pressing tool, whereby some of the powder enters into the interstices 8 between balls 1. Then, an upper cover 9 is put in place, and the tool is sealed by means of sealing sleeves 10 and placed into a conventional isostatic press wherein compression casing 5 will be pressed by a fluid medium at pressures of 30 to 80 hectobars, preferably about 60 hectobars, whereby the powder is compacted radially. As a result, a molded body 1, 3, 7 is obtained containing balls 1 in the desired positions. This molded body may be sintered and by properly selecting the sintering temperature, it is possible that there will be no metallic bonding between balls 1 and embedding material 7. Depending on the materials being processed, sintering is conducted at temperatures from 1000° to 1300° C, preferably at 1280° C, under vacuum or under inert gases in containers provided with a getter material. Similarly, a molded body may be obtained with a central cylindrical cavity by making use of a hollow cylindrical substrate of which the inside wall, for instance, is covered with balls, the elastic compression casing then forming a kind of central core.

By way of example, a powder of suitable composition was placed in the isostatic pressing tool of FIGS. 1 and 2, in which it was compressed into a cylindrical substrate in a conventional isostatic press at 60 hectobars. The substrate was then sintered in vacuum at 1280° C and thereafter provided with lengthwise grooves along the periphery oriented parallel to the cylinder axis. The cylindrical substrate was again placed into the pressing tool of FIG. 1, and balls of a tungsten-nickel-iron alloy of 95% tungsten, 3.5% nickel and 1.5% iron were introduced into the tool making use of a holding sleeve 2. Thereupon, the empty inside space of the pressing tool was filled with a metal powder 7 and the holding sleeve 2 was slowly withdrawn from the tool while the tool and its contents were being vibrated. Then the tool was placed in a conventional isostatic press and compressed again at a pressure of 60 hectobars. The resulting compacted body was then sintered in a vacuum from 1 to 3 hours at 1280° C.

It was also found possible to use substrates already provided with grooves when being compressed and sintered at 700°–900° C and further hardened, partly made of pure iron powder or also of cast low carbon steel. For instance, low carbon steel balls of conventional material were placed in the annular space between two cylindrical substrates and thereupon were compressed together with the two substrates in an isostatic press at 60 hectobars. The cast steel substrates locked the balls by enclosing them and a kind of ball cage was obtained, which was thereafter filled with powder poured into the cage and compressed isostatically and sintered in the manner previously stated.

The products of the present invention are useful as military projectiles which are intended to break up into pieces.

We claim:

1. A process for making molded bodies comprising discrete particles incorporated in a metallic embedding material which comprises:

fixedly positioning said discrete particles to a metallic substrate;

enveloping said discrete particles in a metal powder thereby providing a metallic sheath for said particles;

thereafter isostatically compressing said substrate, together with said metal powder sheath and said discrete particles to produce a molded body; and sintering said molded body after it has been produced by isostatic compression.

2. A process as defined in claim 1 wherein the particles are positioned in recesses of the substrate prior to said isostatic compressing step.

3. A process as defined by claim 1 wherein the particles are positioned magnetically prior to said isostatic compression step.

4. A process as defined by claim 1 wherein the particles are positioned between the substrate and a holding sleeve and then said sleeve is removed prior to isostatic compression.

5. A process as defined by claim 1 wherein the metal powder is compacted by vibration when being introduced around said particles.

6. A process as defined by claim 1 wherein the substrate is produced by a powder metallurgy process.

7. A process as defined by claim 1 and including in addition, surrounding the molded body by a metal powder, isostatically compressing the resulting product and thereafter sintering the product of said compression.

8. A process as defined by claim 4 wherein the particles and metal powder are compacted by vibration while said sleeve is removed.

* * * * *